US007494086B2

(12) United States Patent
Tsai

(10) Patent No.: US 7,494,086 B2
(45) Date of Patent: Feb. 24, 2009

(54) WEB MATERIAL WINDING MACHINE

(75) Inventor: Tung-I Tsai, Taoyuan (TW)

(73) Assignee: Chan Li Machinery Co., Ltd., Taoyuan (TW)

( * ) Notice: Subject to any disclaimer, the term of this patent is extended or adjusted under 35 U.S.C. 154(b) by 52 days.

(21) Appl. No.: 11/785,117

(22) Filed: Apr. 16, 2007

(65) Prior Publication Data

US 2007/0246595 A1 Oct. 25, 2007

(30) Foreign Application Priority Data

Apr. 21, 2006 (TW) ..... 95114469 A

(51) Int. Cl.
*B65H 19/28* (2006.01)

(52) U.S. Cl. ..... 242/532.3; 242/533.1; 242/533.2; 242/542.1

(58) Field of Classification Search ..... 242/532.3, 242/533.1–533.2, 542, 542.1
See application file for complete search history.

(56) References Cited

U.S. PATENT DOCUMENTS

| | | | | |
|---|---|---|---|---|
| 4,327,877 | A * | 5/1982 | Perini | 242/521 |
| 5,137,225 | A * | 8/1992 | Biagiotti | 242/521 |
| 5,248,106 | A * | 9/1993 | Biagiotti | 242/523.1 |
| 5,284,304 | A * | 2/1994 | Biagiotti | 242/526.1 |
| 5,603,467 | A * | 2/1997 | Perini et al. | 242/521 |
| 5,653,401 | A * | 8/1997 | Biagiotti | 242/532.3 |
| 5,853,140 | A * | 12/1998 | Biagiotti | 242/534 |
| 6,056,229 | A | 5/2000 | Blume et al. | |
| 6,877,689 | B2 * | 4/2005 | Butterworth | 242/542.1 |
| 6,945,491 | B2 * | 9/2005 | Gambini | 242/521 |
| 7,175,126 | B2 * | 2/2007 | Perini | 242/532.3 |
| 7,198,221 | B2 * | 4/2007 | Betti et al. | 242/533.2 |
| 7,350,739 | B2 * | 4/2008 | Maddaleni et al. | 242/542 |
| 7,360,738 | B2 * | 4/2008 | Perini | 242/532.3 |

FOREIGN PATENT DOCUMENTS

| | | |
|---|---|---|
| EP | 1232980 | 2/2001 |
| EP | 1520814 | 4/2005 |
| WO | WO01/64563 | 9/2001 |
| WO | WO2004/035441 | 4/2004 |
| WO | WO2007/083336 | 7/2007 |

OTHER PUBLICATIONS

Communication from the European Patent Office dated Sep. 27, 2007.

* cited by examiner

*Primary Examiner*—Sang Kim
(74) *Attorney, Agent, or Firm*—Rosenberg, Klein & Lee

(57) ABSTRACT

A web material winding machine includes a core tube storage tank, a guiding unit, a transmission means, a web material feeding assembly, a gripping assembly and a second gluing mechanism. A glued core tube is conveyed from the guiding unit to the transmission means and the web material is fed to the transmission means. The transmission means pushes the core tube to move to the gripping assembly and the web material is stuck to the core tube. The web material winds around the working core tube and when the winding is nearly completed, a new core tube is conveyed to the transporting passage and interferes with the feeding speed of the web material, causing the web material to tear along a line of perforations. A tail glue is applied to the web material of the web-wound roll by the second gluing mechanism and a web-wound roll is produced.

8 Claims, 13 Drawing Sheets

WEB MATERIAL WINDING MACHINE

FIELD OF THE INVENTION

The present invention relates to a winding machine, and more particularly to a winding machine for winding a web material around a core tube to producing a web-wound roll.

BACKGROUND OF THE INVENTION

Winding machine is commonly used in the pulp and paper industry and textile industry for producing smaller diameter logs or rolls of web material from large diameter parent rolls. For example, winding machines are used in the paper converting industry to produce rolls of toilet paper, kitchen towel and the like.

A conventional winding machine is provided with a presser which has a surface with high coefficient of friction and which exerts a pressure to impede the forward movement of the web material. This results to the tearing off of the web material. Alternatively, a severing means having sharp, saw-toothed blades is used to sever the web material. An example is shown in U.S. Pat. No. 5,979,818 which discloses a rewinding machine for the formation of logs of web materials. In the patent, a material-severing device is provided for severing the web material when the winding of web material is completed.

Either the presser or severing means has to work with a stroke and timing control device, such as an automatic timing control roller, an automatic timing control cam or linkage assembly, etc. The presser is driven to act on the web material at a predetermined severing timing by the stroke and timing control device, such as at pressing timing or clipping timing. Such a design inevitably increases the manufacture cost and complicates the control system.

Moreover, it is necessary to precisely control the timing or stroke for the winding device. Once the presser is damaged, the stroke is offset out of a preset stroke, or the timing control is not correct and lapses from the preset timing, the web material is cut at the improper time and it would result to poor quality of the logs.

Thus, it is desired to provide a winding machine that does not require the installation of any pressing means to simplify the control of the winding machine and the manufacture cost.

SUMMARY OF THE INVENTION

A primary object of the present invention is to provide a web material winding machine which is able to tear a web material by arranging a transporting passage. The transporting passage has a dimension that is slightly smaller than the diameter of the core tube. The new working core tube conveying on the transporting passage presses on the web material, generating an interference with the speed of the web material and causing the tearing of the web material. No presser or severing means is needed for severing the web material.

Another object of the present invention is to provide a winding machine that tears the web material to complete a web-wound roll whenever a new core tube is delivered to the transporting passage. No timing control device is needed for controlling the tearing of the web material.

To fulfill the above objects, the present invention provides a web material winding machine. The winding machine comprises a core tube storage tank, a guiding unit, a transmission means, a web material feeding assembly, a gripping assembly and a second gluing mechanism. A core tube is glued with initial glue and conveyed from the guiding unit to the transmission means. Meanwhile, the web material is fed by the web material feeding assembly to the transmission means at a normal speed. The transmission means pushes the core tube to move through a transporting passage to the gripping assembly and the web material is stuck to the core tube. The web material winds around the working core tube at the winding region. When the winding is nearly completed, a new core tube is conveyed to the transporting passage and interferes with the speed of web material, causing the web material to tear along a line of perforations across the web material. A tail glue is applied to the web material of the web-wound roll by the second gluing mechanism and a web-wound roll is produced.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
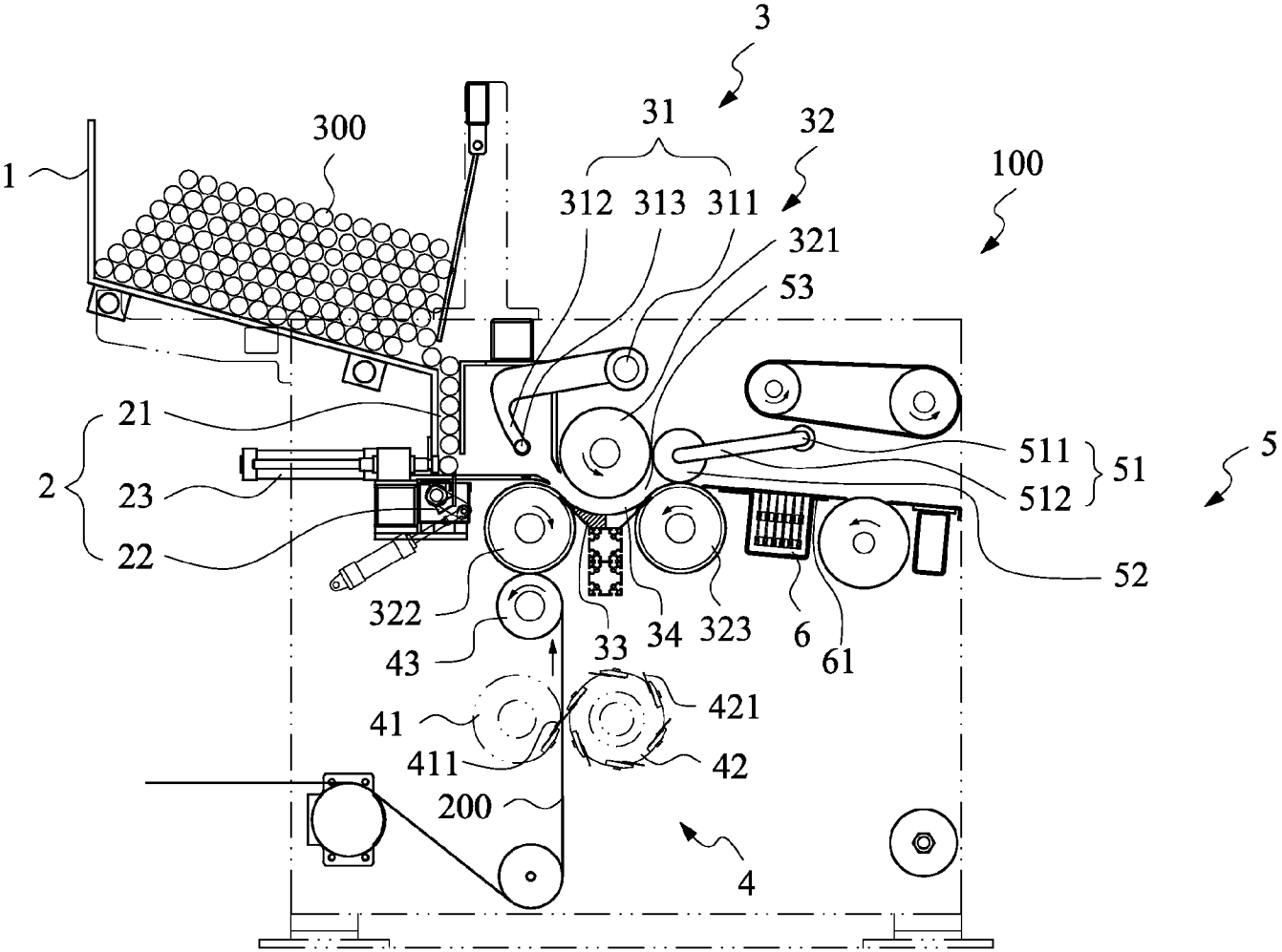
FIG. 1 is a schematic view of a web material winding machine constructed in accordance with a preferred embodiment of the present invention.

With reference to the drawings and in particular to FIG. 1 which is the schematic view of a web material winding machine constructed in accordance with a preferred embodiment of the present invention. A web material winding machine 100 is adapted to wind a web material 200 to a core tube 300. The winding machine 100 includes a core tube storage tank 1, a guiding unit 2, a transmission means 3, a web material feeding assembly 4, a gripping assembly 5 and a second gluing mechanism 6.

The core tube storage tank 1 contains with a plurality of core tubes 300 and has an opening (not labeled) at the right bottom corner for supplying the core tubes 300. The guiding unit 2 communicates with the opening of the core tube storage tank 1 and includes a guiding passage 21, a first gluing mechanism 22 and a pushing mechanism 23. The first gluing mechanism 22 contains glue. The guiding passage 21 connects the core tube storage tank 1 to the pushing mechanism 23. Through the guiding passage 21, the core tube 300 is conveyed from the core tube storage tank 1 to the platform of the pushing mechanism 23. Then, the first gluing mechanism 22 applies an initial glue to the core tube 300 on the platform of the pushing mechanism 23. The pushing mechanism 23 has a retractable arm that pushes the glued core tube 300 along the platform to the transmission means 3.

Figure 3:
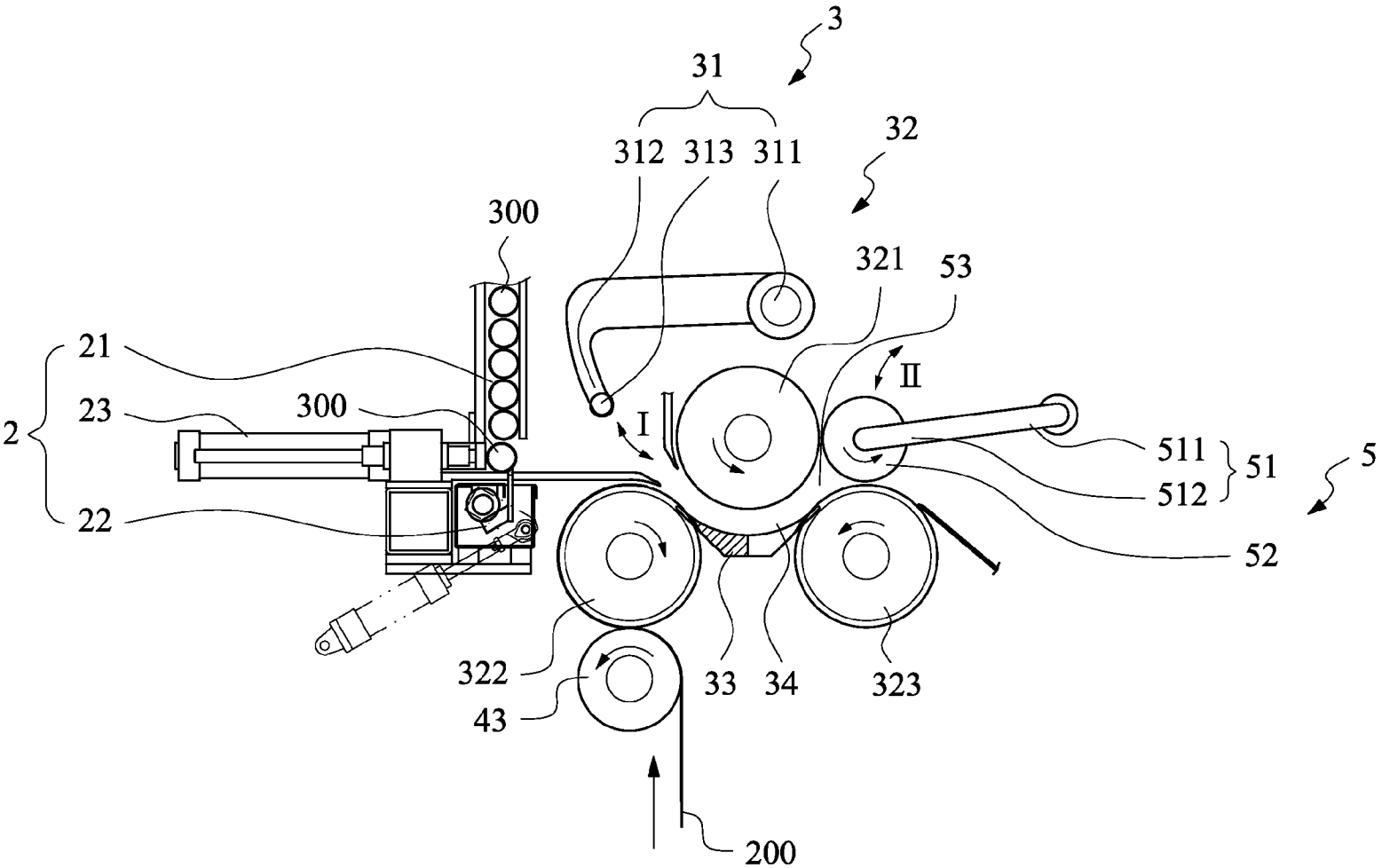
FIG. 3 is a schematic view showing the delivery of core tubes to a guiding unit of the web material winding machine of FIG. 1.

The transmission means 3 includes an oscillable feeding arm 31, a roller assembly 32 and a rolling guiding mechanism 33. The feeding arm 31 is located above the pushing mechanism 23 and has a fixed end 311, a pushing end 312 and a pushing roller 313. The feeding arm 31 is pivoted at the fixed end 311 such that the pushing end 312 is movable along a first oscillating orbit I as shown in FIG. 3. The pushing roller 313 is mounted to the pushing end 312 of the feeding arm 31 for pushing the core tube 300 forward along the oscillating orbit I.

The roller assembly 32 includes a first roller 321, a second roller 322 and a third roller 323. The first roller 321 is located nearby the feeding arm 31. The second roller 322 and the third roller 323 are below the first roller 321 and are respectively positioned at the two sides of the first roller 321. A clearance is formed between the first roller 321 and the second roller 322. The clearance is on the oscillating orbit I. A clearance is also formed between the second roller 322 and the third roller 323.

The rolling guiding mechanism 33 is arranged between the second roller 322 and the third roller 323, forming a continuous curved surface between the second roller 322 and the third roller 323. The rolling guiding mechanism 33 and the first roller 321 defines a transporting passage 34 therebetween for conveying the core tube 300.

Figure 11:
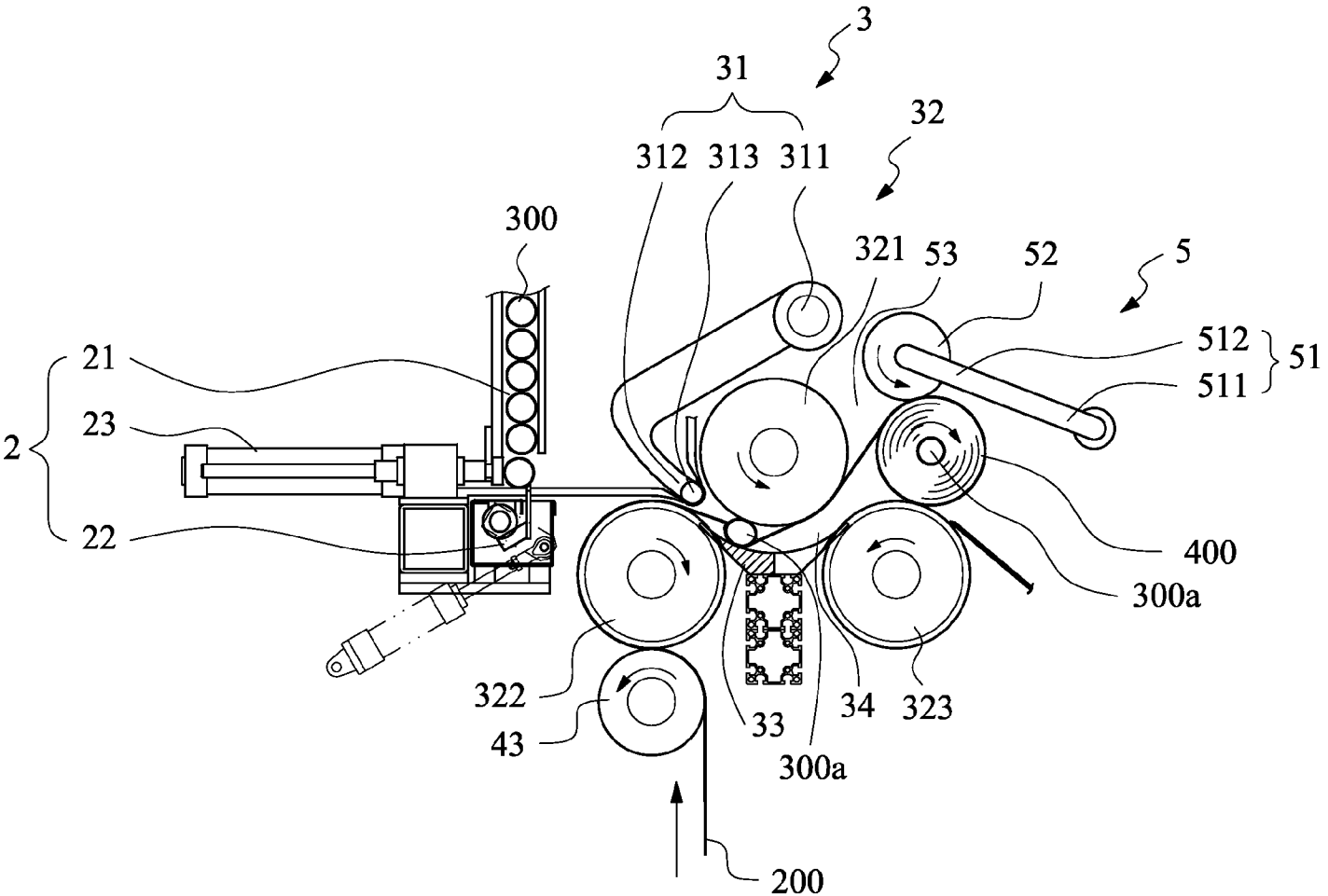
FIG. 11 is a schematic view showing that the new working core tube presses on the web material.

In order to strengthen the interference action of the new working core tube 300*a* at the transporting passage 34 to the feeding of web material 200 (as shown in FIG. 11), the transporting passage 34 is designed to have a width slightly smaller than the diameter of the core tube 300. Therefore, when the working core tube 300*a* is conveyed along the transporting passage 34, the working core tube 300*a* is squeezed to deform slightly, turning into oval shape.

The web material 200 is fed through the web material feeding assembly 4 to the roller assembly 32. The web material feeding assembly 4 includes a counter roller 41, a perforation roller 42 and a feeding roller 43. The counter roller 41 is provided with at least one counter blade 411, and the perforation roller 42 is provided with a plurality of blades 421 regularly spaced at the periphery of the perforation roller 42. The counter blade 411 of the counter roller 41 operates in coordination with the blades 421 of the perforation roller 42. During operation, the web material 200 is conveyed to the feeding roller 43 through a passage between the counter roller 41 and the perforation roller 42. Meanwhile, the blades 421 of the perforation roller 42 pierce through the web material 200 to the counter blade 411 of the counter roller 41, forming a line of perforations across the web material 200. The perforation roller 42 is driven to rotate at a predetermined speed such that a perforation line is produced at the web material 200 for each predetermined distance. The feeding roller 43 is located below the second roller 322 for feeding the web material 200 to the second roller 322.

The gripping assembly 5 includes an oscillable gripping arm 51 and a gripping roller 52. The gripping arm 51 has a fixed end 511 and a gripping end 512. The gripping end 512 is pivoted at the fixed end 511, such that the gripping end 512 is movable along a second oscillating orbit II as shown in FIG. 3. The gripping roller 52 is mounted to the gripping end 512 and is adjacent to the first roller 321 and above the third roller 323 for gripping the working core tube 300*a*. A winding region 53 is defined among the first roller 321, the third roller 323 and the gripping roller 52.

Figure 2:
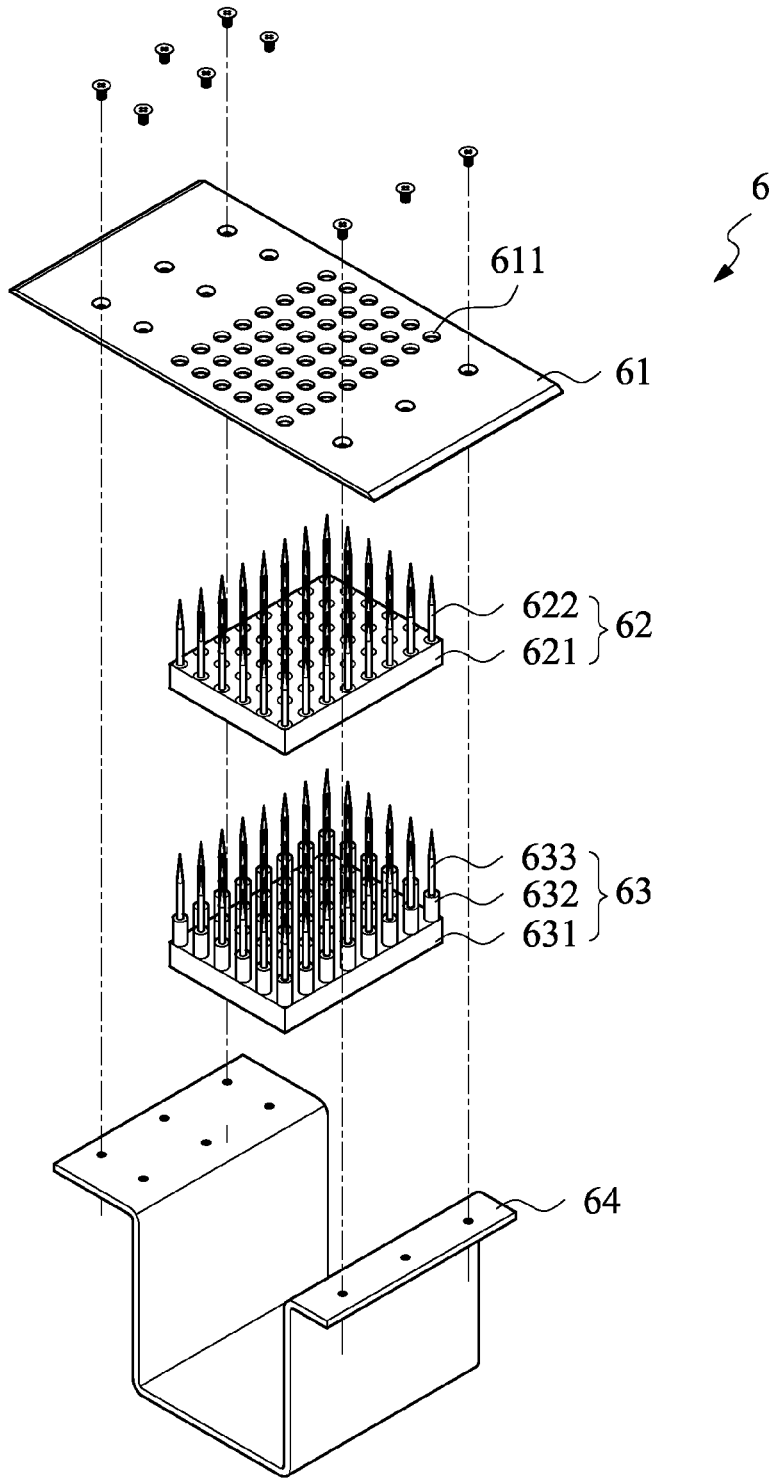
FIG. 2 is an exploded perspective view showing a second gluing mechanism of the web material winding machine of FIG. 1.

Please refer to FIG. 2, which is an exploded perspective view showing a second gluing mechanism of the web material winding machine of FIG. 1. The second gluing mechanism 6 is arranged adjacent to the third roller 323 and tilts downward. The second gluing mechanism 6 includes a cover plate 61, an injector 62, a glue supply 63 and a casing 64. The cover plate 61, the injector 62 and glue supply 63 are aligned with each other and are piled together from top to bottom in sequence. The casing 64 is fastened to the plate 61 by screws for accommodation and protection of the injector 62 and glue supply 63 therebetween.

Figure 9:
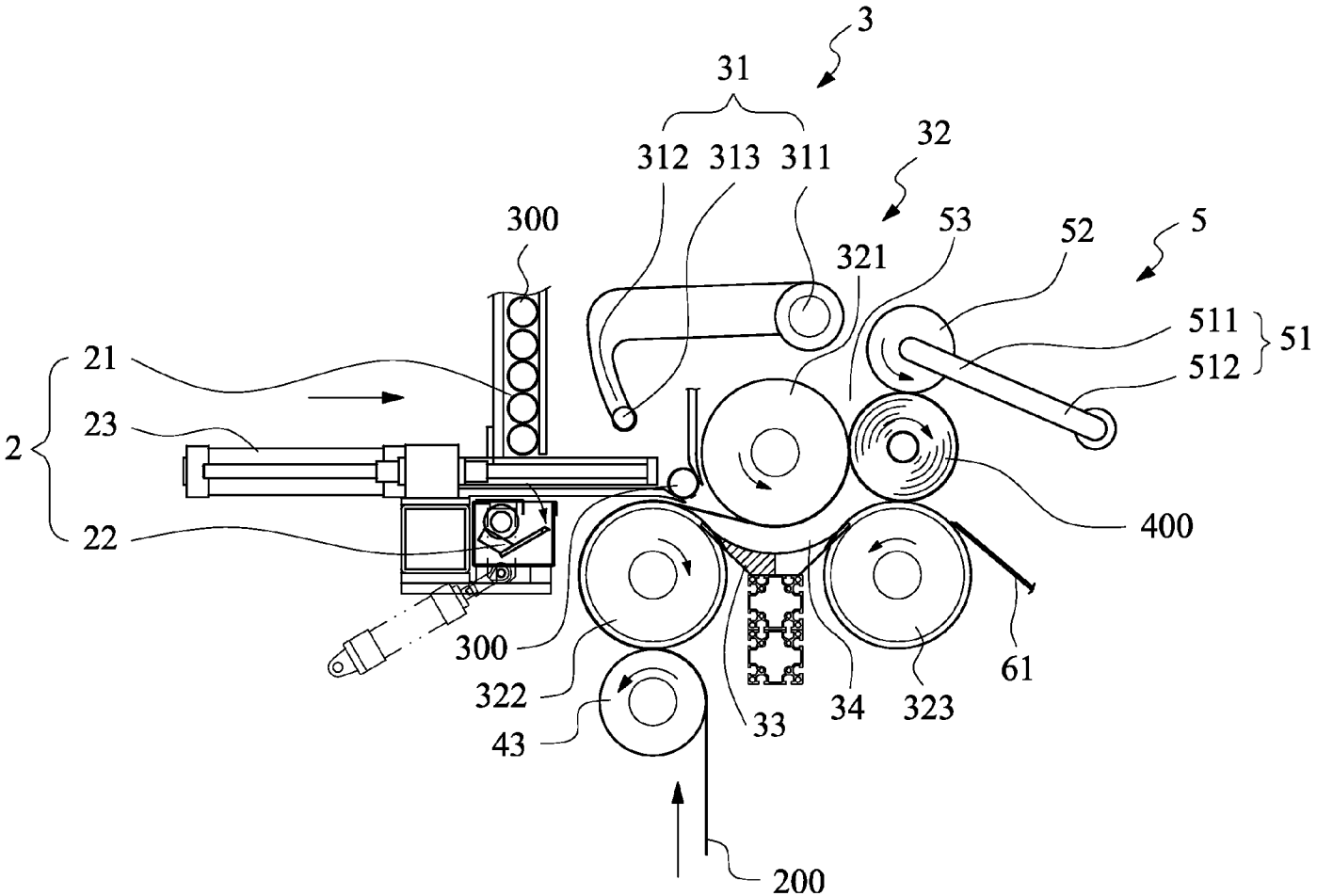
FIG. 9 is a schematic view showing that the winding of the working core tube is nearly completed and a new core tube is conveyed to the transmission means.

The cover plate 61 is perforated with a plurality of apertures 611. The injector 62 is provided with a support base 621 and a plurality of injecting needles 622. Each of the injecting needles 622 aligns with an aperture 611 located above. The glue supply 63 comprises a support base 631, a plurality of tubes 632 and a plurality of ducts 633. The tubes 632 are supported on the support base 631. Each of the tubes 632 is connected with a duct 633 which is aligned with an injecting needle 622 above the glue supply 63. The tubes 632 contain glue and supply the glue through the ducts 633 to the injecting needles 622. When a web-wound roll 400 (as shown in FIG. 9) rolls across the cover plate 61, the injector 62 injects tail glue through the apertures 611 to the web material 200 of the web-wound roll 400.

Please refer to FIGS. 3 to 13 that show an operation of the web material winding machine of FIG. 1. FIG. 3 is a schematic view showing the delivery of core tubes to the guiding unit of the web material winding machine of FIG. 1. As shown, the core tubes 300 are delivered one by one from the core tube storage tank 1 through the guiding passage 21 to the platform of the pushing mechanism 23. The first gluing mechanism 22 of the guiding unit 2 applies initial glue to the core tube 300.

Figure 4:
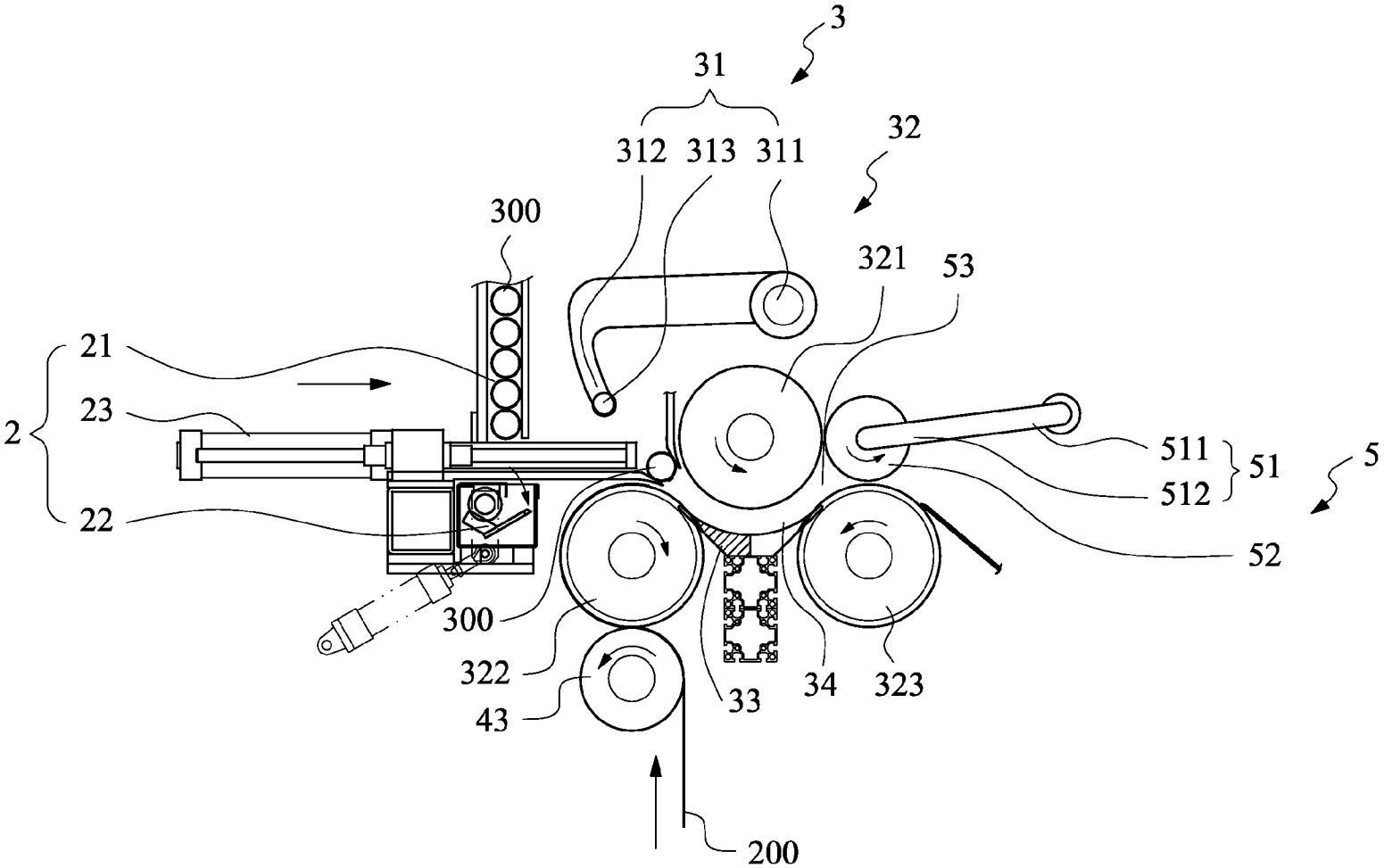
FIG. 4 is a schematic view showing that a core tube is conveyed to a transmission means of the web material winding machine.

FIG. 4 is a schematic view showing that the core tube is conveyed to the transmission means 3 of the web material winding machine. The glued core tube 300 is pushed forward by the retractable arm of the pushing mechanism 23 along the platform to the transmission means 3. In the meantime, the web material 200 is conveyed through the web material feeding assembly 4 to the roller assembly 32. The blades 421 (as shown in FIG. 1) of the perforation roller 42 works with the counter blade 411 of the counter roller 41, producing a line of perforations across the web material 200.

Figure 5:
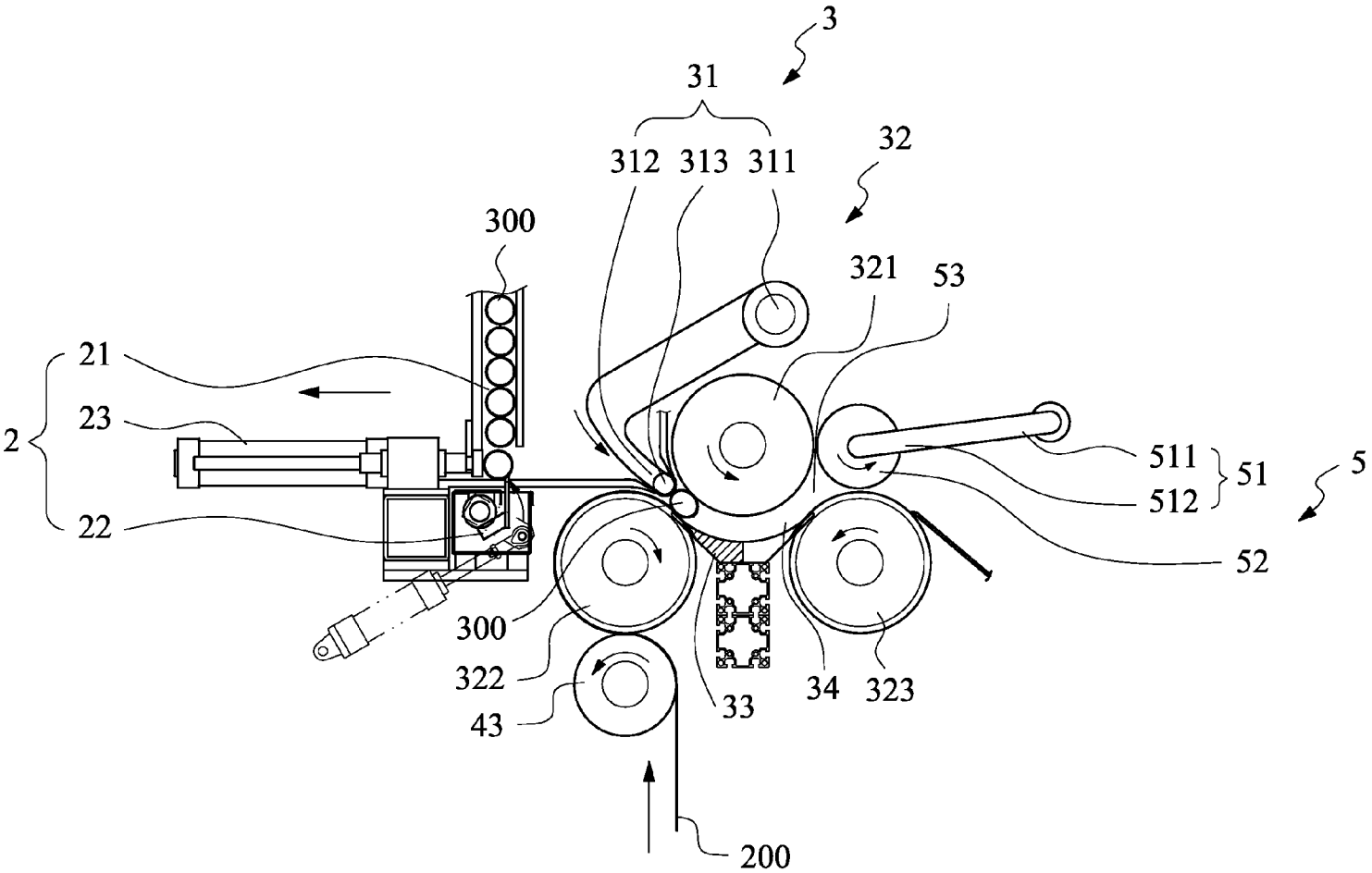
FIG. 5 is a schematic view showing that the core tube is conveyed to a transporting passage of the transmission means.

FIG. 5 is a schematic view showing that the core tube is conveyed to the transporting passage of the transmission means. The feeding arm 31 oscillates around the fixed end 311, and accordingly, the pushing end 312 moves along the first oscillating orbit I (as shown in FIG. 3). It can be seen from FIG. 5 that the pushing roller 313 pushes the core tube 300 to displace into the transporting passage 34. As mentioned, the transporting passage 34 has a width slightly smaller than the diameter of the core tube 300. Therefore, when the working core tube 300*a* (as shown in FIG. 6) is conveyed along the transporting passage 34, the working core tube 300*a* is squeezed to oval shape.

Figure 6:
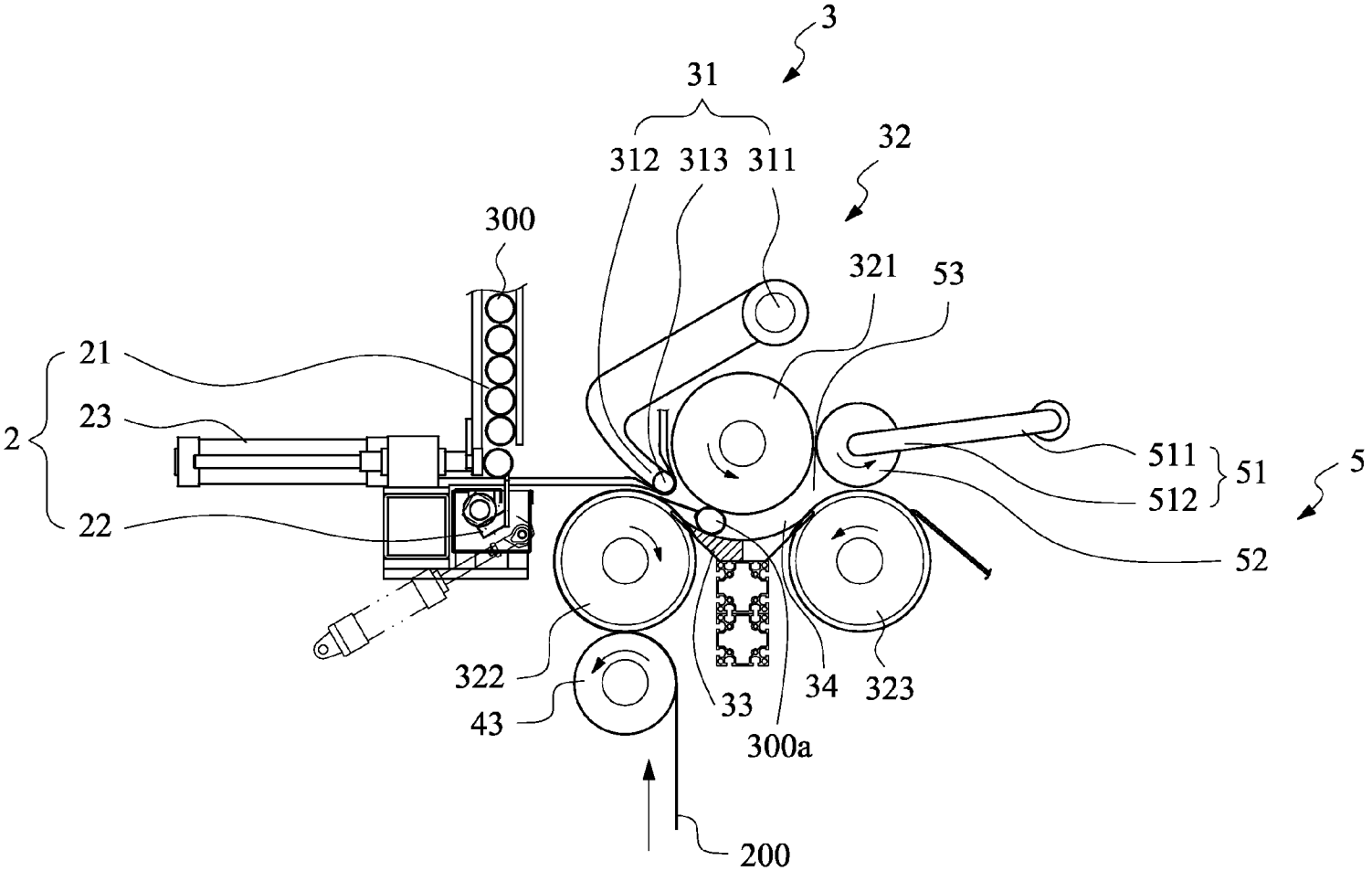
FIG. 6 is a schematic view showing that a web material is stuck to the core tube.
Figure 7:
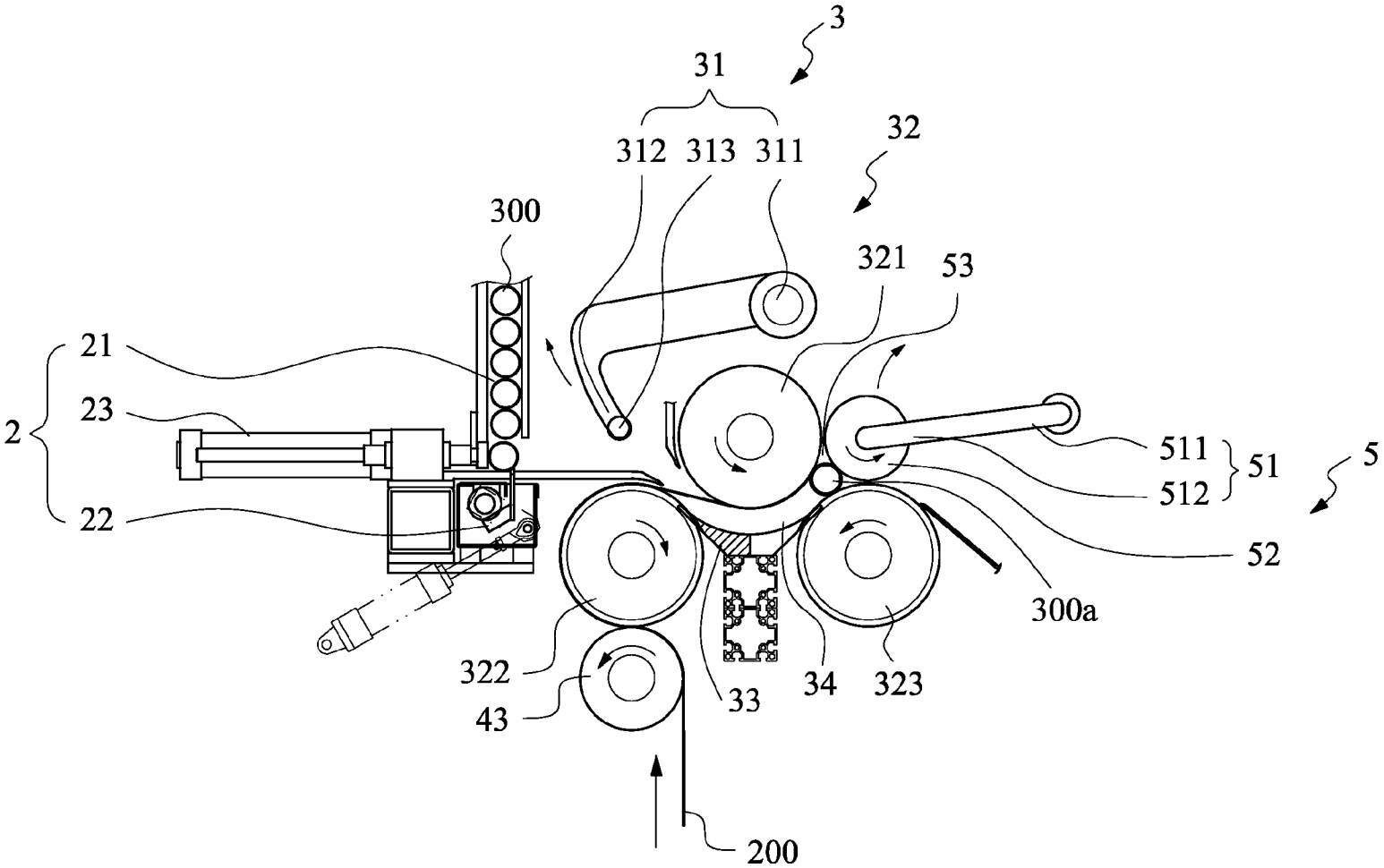
FIG. 7 is a schematic view showing a working core tube is gripped by a gripping arm.

Once entering the transporting passage 34, the core tube 300 contacts the web material 200 and sticks the web material 200 by the initial glue applied by the first gluing mechanism 22, forming a working core tube 300*a* , as it can be seen from FIG. 6. The relative motion between the first roller 321 and the rolling guiding mechanism 33 drives the working core tube 300*a* to move along the transporting passage 34. FIG. 7 is a schematic view showing that the working core tube 300*a* reaches the winding region 53 of the gripping assembly 5 and is gripped by the gripping arm 51. At the same time, the feeding arm 31 swings back to its original position.

Figure 8:
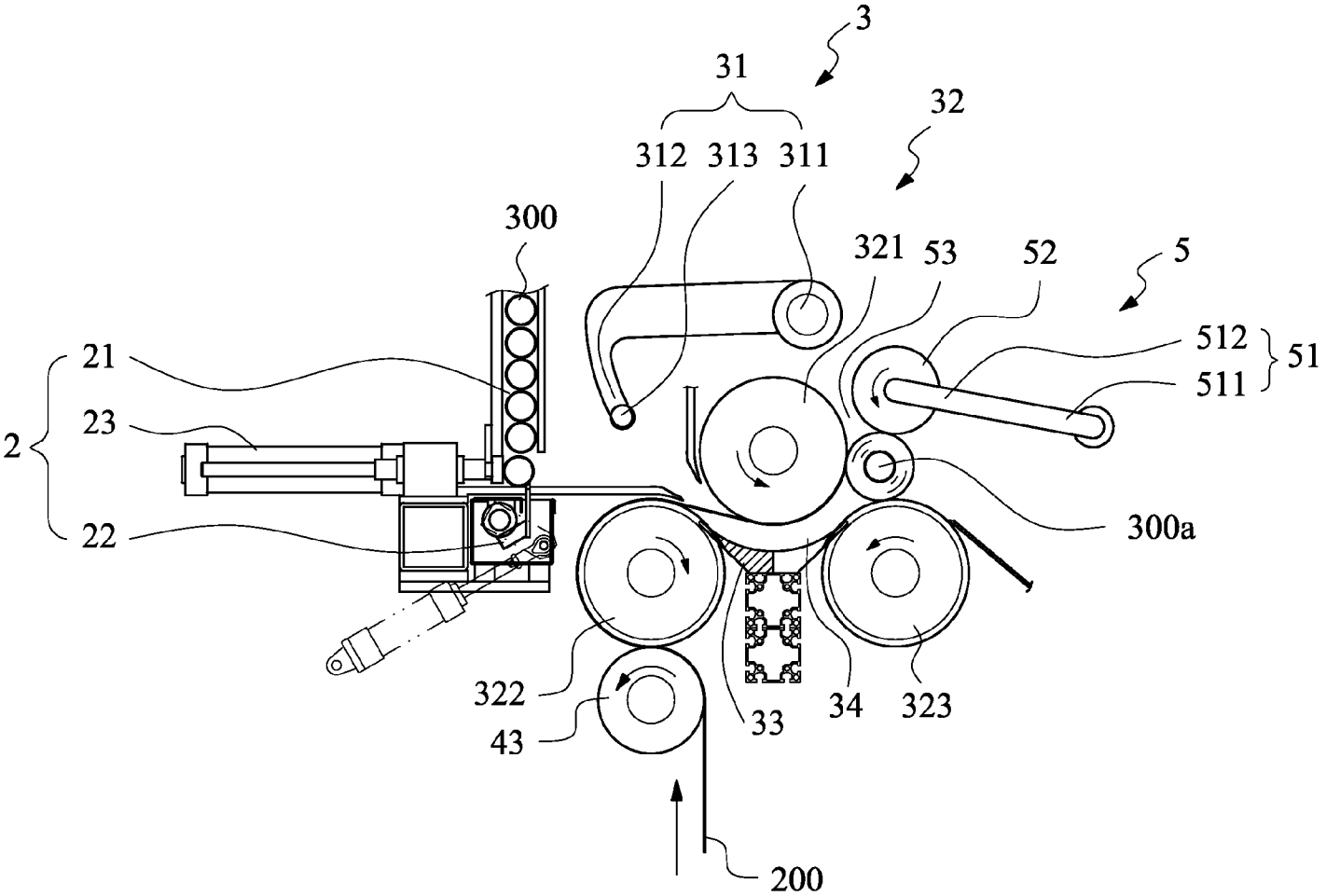
FIG. 8 is a schematic view showing that the working core tube is proceeding winding work in the winding region.

Please refer to FIG. 8. The working core tube 300*a* is driven to rotate to wind the web material 200 thereon at the winding region 53. When the winding of the working core tube 300*a* is nearly completely, the first gluing mechanism 22 applies initial glue to a new core tube 300. The operation of the guiding unit 2 is controlled by a control means. The control means may be any conventional control device that can be preset with various operation parameters, e.g. the timing of release of core tube from the guiding unit 2.

FIG. 9 is a schematic view showing the new core tube 300 is conveyed to the transmission means 3. The glued new core tube 300 is pushed forward by the arm of the pushing mechanism 23 along the platform to the transmission means 3. The working core tube 300*a* at the winding region 53 keeps on winding at the normal speed.

Figure 10:
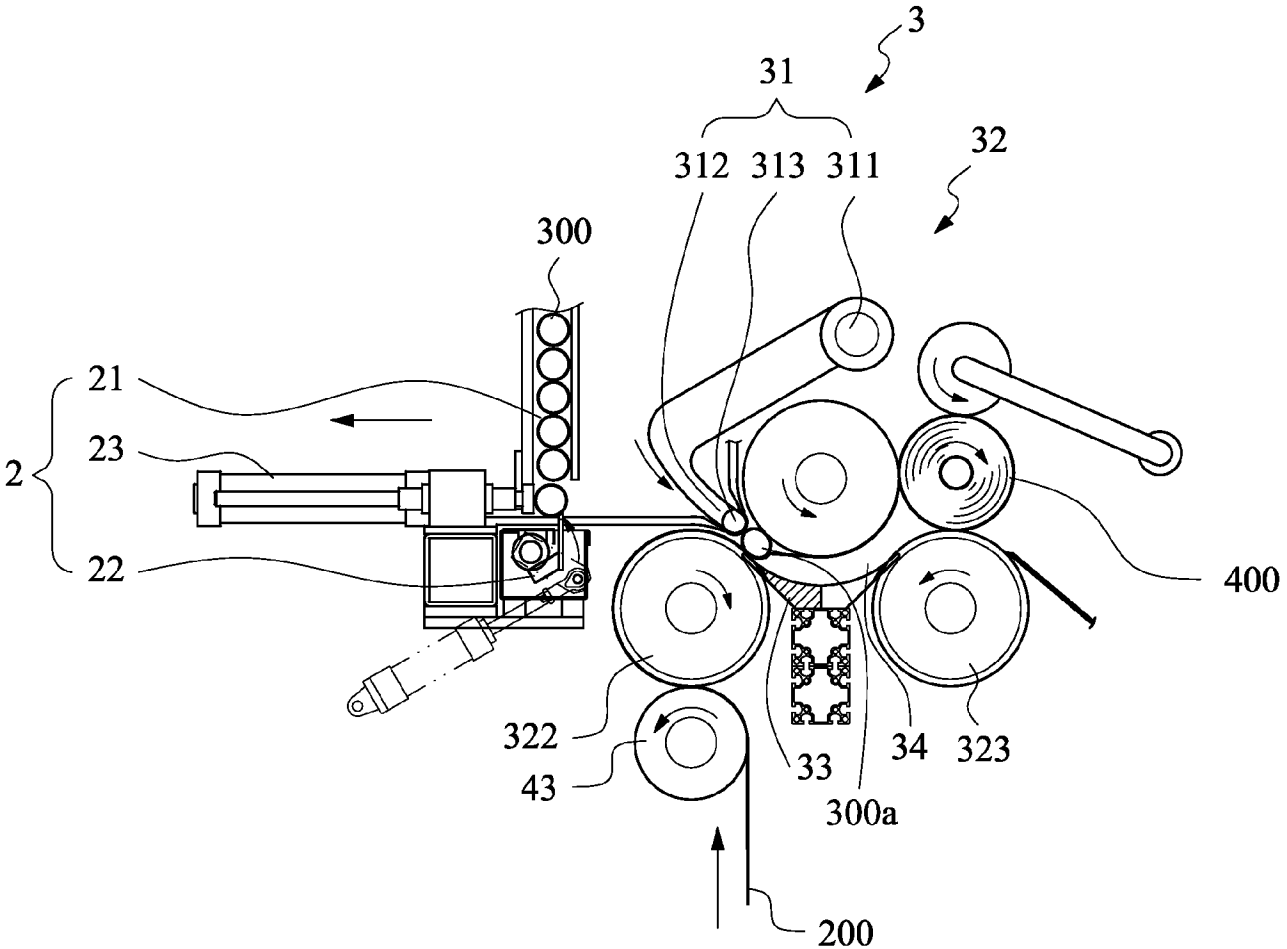
FIG. 10 is a schematic view showing that the web material is stuck on the new core tube that enters the transporting passage.

FIG. 10 is similar to FIG. 3. In the drawing, the new core tube 300 is pushed to enter the transporting passage 34 by the feeding arm 31. Once entering the transporting passage 34, the core tube 300 contacts the web material 200 and sticks the web material 200 by the initial glue applied by the first gluing mechanism 22, forming a new working core tube 300*a*.

Please refer to FIG. 11, a schematic view showing the new working core tube at the transporting passage presses on the web material feeding to the working core tube at the winding region. The new working core tube 300*a* moves through the transporting passage 34 and is squeezed to become oval shape. The new working core tube 300*a* at the transporting passage 34 presses on the web material 200, and therefore, the new working core tube 300*a* at the transporting passage 34 interferes the movement of the web material 200. This interference action slows down the feeding speed of the web material 200 or even stops the feeding of the web material 200. However, the working core tube 300*a* at the winding region 53 keeps rotation at its normal speed.

Figure 12:
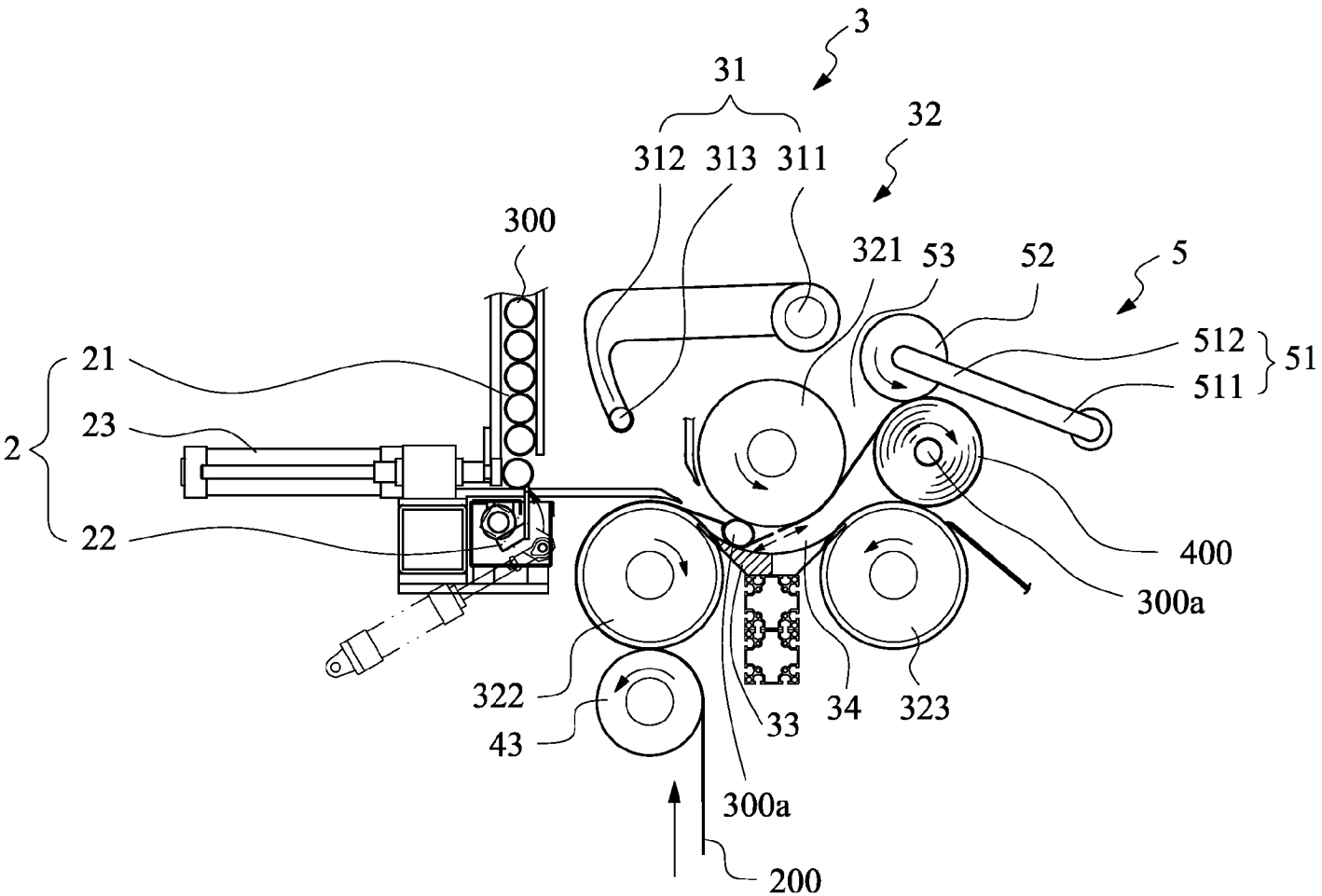
FIG. 12 is a schematic view showing the tearing of web material.

Accordingly, a pulling force is generated to the web material 200. FIG. 12 is a schematic view showing the tearing of the web material. The pulling force causes the web material 200 to tear along the perforation line. Hence, the winding of the working core tube 300*a* at the winding region 53 is completed and a web-wound roll 400 is produced.

Figure 13:
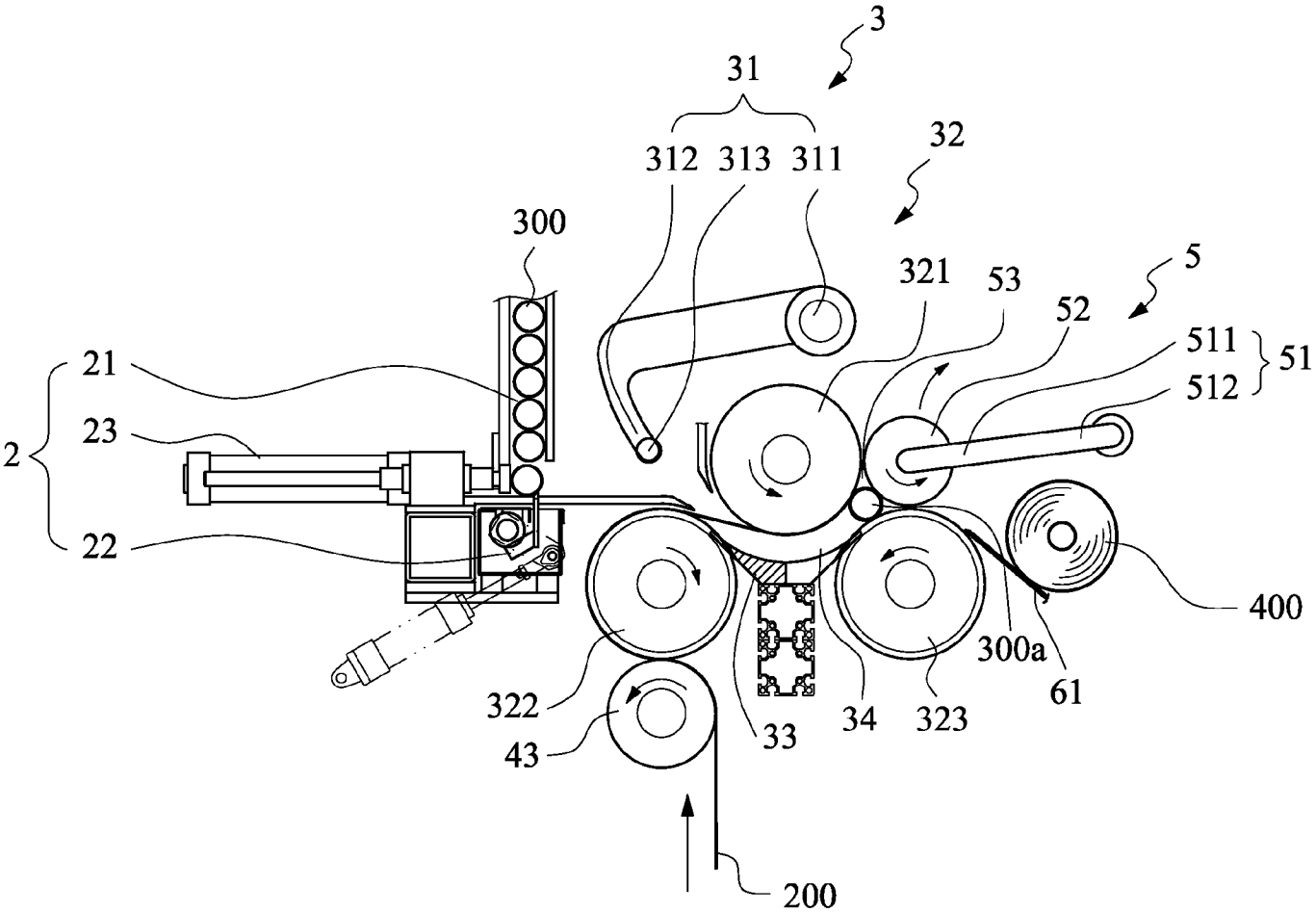
FIG. 13 is a schematic view showing that a web-wound roll leaves the winding region and a new working core tube is conveyed to the winding region.

FIG. 13 shows that the web-wound roll 400 leaves the winding region 53 and the new working core tube 300*a* is conveyed to the winding region 53. With reference to FIGS. 1 and 2, as the second gluing mechanism 6 tilts downward, the web-wound roll 400 leaves the winding region 53 and rolls across the cover plate 61 of the second gluing mechanism 6 (as shown in FIG. 1). At this moment, the second gluing mechanism 6 injects tail glue through the apertures 611(as shown in FIG. 2) to the web material 200 of the web-wound roll 400. The web material 200 is adhered by the tail glue to the web-wound roll 400. The processing to the web-wound roll 400 is accomplished. The injection of the tail glue by the second gluing mechanism 6 is also controlled by the control means. Meanwhile, the new working core tube 300*a* is conveyed to the winding region 53.

At predetermined time, the control means drives the injector 62 and the glue supply 63 to lift up such that the injecting needles 622 reaches the apertures 611 and are close to the web-wound roll 400, and the injecting needles 622 inject tail glue to the web-wound roll 400. After injection, the injector 62 and the glue supply 63 returns to its original position. The upward and downward movement of the injector 62 and the glue supply 63 are achieved by a retractable lifting device. The lifting device may comprise spiral pins, springs or other effective elements.

In the present invention, the tearing of the web material is achieved by the interference action of the new working core tube at the transporting passage. The winding machine tears the web material whenever a new core tube is delivered to the transporting passage. No presser or severing means is required. Hence, no time control device is needed for controlling the working of the presser. The manufacture, operation and maintenance of the winding machine are simplified. It significantly reduces the manufacture, operation and maintenance cost.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A winding machine for winding a web material comprising:

a core tube storage tank, which contains a plurality of core tubes;

a guiding unit, which is connected to the core tube storage tank for delivery of the core tubes one by one from the core tube storage tank according to a preset timing and has a first gluing mechanism for injecting an initial glue to the core tubes;

a transmission means comprising:

an oscillable feeding arm, which comprises a fixed end and a pushing end pivoted at the fixed end, wherein the pushing end for pushing the core tube operates to oscillate for pushing the core tube delivered from the guiding unit along a first oscillating orbit;

a roller assembly comprising:

a first roller, which is arranged nearby the oscillable feeding arm;

a second roller, which is arranged below the first roller, and a clearance is formed between the first roller and the second roller at the first oscillating orbit; and a third roller, which is arranged below the first roller; and a rolling guiding mechanism, which is arranged between the second roller and the third roller, and defining a transporting passage between the first roller and the rolling guiding mechanism;

a web material feeding assembly, which is adjacent to the transmission means for feeding the web material to the transmission means; and an oscillable gripping assembly comprising:

an oscillable gripping arm, which has a fixed end and a gripping end pivoted at the fixed end, wherein the gripping end being operable to oscillate along a second oscillating orbit for holding a roll; and a gripping roller, which is mounted to the gripping end, wherein a winding region is defined among the first roller, the third roller and the gripping roller;

wherein at operation, the core tube is fed from the core tube storage tank to the guiding unit, applied with the initial glue by the first gluing mechanism and conveyed to the transmission means which pushes the core tube from the guiding unit to the transporting passage, and meanwhile, the web material is fed from the web material feeding assembly, stuck on the core tube at the transporting passage to form a working core tube and wound around the working core tube, and then the working core tube is conveyed through the transporting passage to the winding region and proceeding winding at a predetermined speed, a new core tube being fed by the guiding unit to the transmission means when the working core tube at the winding region nearly completing winding work, and the transportation of the new working core tube at the transporting passage interferes with the feeding speed of the web material, causing the tearing of the web material connected between the working core tube at the winding region and the new working core tube at the transporting passage and therefore a web-wound roll is produced.

2. The winding machine as claimed in claim 1, wherein the guiding unit further comprises:

a guiding passage, which is connected to the core tube storage tank for delivery of core tubes from the core tube storage tank to the first gluing mechanism for applying the initial glue to the core tubes; and a pushing mechanism which pushes the core tube from the first gluing mechanism to the transmission means after the core tube is applied with the initial glue.

3. The winding machine as claimed in claim 1, wherein the pushing end of the oscillable feeding arm further comprises a pushing roller.

4. The winding machine as claimed in claim 1, wherein the winding machine further comprises a second gluing mechanism including a cover plate, an injector and a glue supply, which are aligned with each other and piled together from top to bottom in sequence, the second gluing mechanism injecting tail glue to the web-wound roll.

5. The winding machine as claimed in claim 4, wherein the cover plate is provided with a plurality of injecting apertures.

6. The winding machine as claimed in claim 4, wherein the injector is provided with a plurality of injecting needles correspondingly located under the injecting apertures.

7. The winding machine as claimed in claim 4, wherein the glue supply is provided with a plurality of tubes containing glue and each of the tubes is connected with a duct for providing glue to the corresponding injecting needles.

8. The winding machine as claimed in claim 1, wherein the web material feeding assembly further comprising:

a counter roller provided with at least one counter blade; and a perforation roller provided with a plurality of blades regularly spaced at the periphery of the perforation roller;

wherein the counter blade of the counter roller operates in coordination with the blades of the perforation roller to form a line of perforations at the web material.

* * * * *